United States Patent [19]

Schulz et al.

[11] 4,305,728

[45] Dec. 15, 1981

[54] COAL SUSPENSIONS AND PROCESS FOR PREPARING SAME

[75] Inventors: Johann G. Schulz, Pittsburgh; John A. Cobler, Harwick, both of Pa.

[73] Assignee: Gulf Research & Development Company, Pittsburgh, Pa.

[21] Appl. No.: 218,460

[22] Filed: Dec. 19, 1980

Related U.S. Application Data

[63] Continuation-in-part of Ser. No. 110,798, Jan. 9, 1980, Pat. No. 4,261,701.

[51] Int. Cl.[3] ..... C10L 1/18

[52] U.S. Cl. ..... 44/51; 252/352; 252/356

[58] Field of Search ..... 44/51, 70, 72, 60; 252/311.5, 352, 356, 357

[56] References Cited

U.S. PATENT DOCUMENTS

| | | | |
|---|---|---|---|
| 4,104,035 | 8/1978 | Cole | 44/51 |
| 4,147,882 | 4/1979 | Schulz et al. | 562/410 |
| 4,163,644 | 8/1979 | Bowers | 44/51 |

*Primary Examiner*—Jacqueline V. Howard

*Attorney, Agent, or Firm*—Deane E. Keith; Forrest D. Stine; Joseph J. Carducci

[57] ABSTRACT

A suspension containing (A) water and (B) the product resulting from the reaction of (1) coal having a neutral equivalent of about 150 to about 485 with (2) a base. The process for preparing such suspension is also claimed.

32 Claims, No Drawings

COAL SUSPENSIONS AND PROCESS FOR PREPARING SAME

This application is a continuation-in-part application of our application Ser. No. 110,798 for Uniform Coal Suspensions and Process for Preparing Same, now U.S. Pat. No. 4,261,701.

BACKGROUND OF THE INVENTION

1. Field of the Invention

This invention relates to coal suspensions containing (A) water and (B) the product resulting from the reaction of (1) coal having a neutral equivalent of about 150 to about 485 with (2) a base and to a process for preparing such suspension.

2. Description of the Prior Art

Coal suspensions are well-known and are widely used, for example, in transporting coal, as fuel mixtures, in coal reactions or conversions, etc. It is an object herein to provide a suspension requiring the presence therein of only the coal to be suspended therein and water.

SUMMARY OF THE INVENTION

We have prepared stable coal suspensions containing solely (A) water and (B) the product resulting from the reaction of the coal to be suspended therein, said coal having a neutral equivalent of about 150 to about 485 with (2) a base.

The suspensions prepared herein can utilize any of the well-known coals. Thus, bituminous and subbituminous coal, lignitic materials and other types of coal products are exemplary of coals that are suitable in the preparation of the novel coal suspensions claimed herein. Some of these coals in their raw state will contain relatively large amounts of water. These can be dried prior to use, if desired, and preferably can be ground in a suitable attrition machine, such as a hammermill, to a size such that at least about 50 percent of the coal will pass through a 40-mesh (U.S. Series) sieve. The carbon and hydrogen content of the coal are believed to reside primarily in multi-ring aromatic and non-aromatic (condensed and/or uncondensed), heterocyclic compounds, etc. On a moisture-free, ash-free basis the coal can have the following composition:

TABLE I

| | Weight Per Cent | |
|---|---|---|
| | Broad Range | Preferred Range |
| Carbon | 49–95 | 60–85 |
| Hydrogen | 2.2–8 | 5–7 |
| Oxygen | 2–46 | 8–40 |
| Nitrogen | 0.7–3 | 1–2 |
| Sulfur | 0.1–10 | 0.2–5 |

In order to suspend the above-identified coal in water to form the novel suspension defined herein, it is critical that such coal first possess sufficient carboxylic acid functions such that it possesses a neutral equivalent in excess of about 150 but not greater than about 485, preferably in excess of about 180 but not greater than about 480. By "neutral equivalent" we mean the grams of such coal needed to neutralize one mol of sodium hydroxide. When coals are used having a neutral equivalent in excess of about 485 the suspension prepared using such coal is not stable. On the other hand, when suspensions are prepared using coals having a neutral equivalent below about 150, such coals become soluble therein. By "stable" we mean to define a water-coal suspension wherein no appreciable amount of the coal portion thereof will precipitate or settle out from the water component thereof for at least about eight days, generally for a period of about 10 to about 90 days.

If the coal to be used does not already possess the neutralization equivalent values defined above, the coal is first subjected to any conventional or suitable treatment sufficient to obtain a coal product possessing such neutralization equivalent values. For example, a stirred aqueous slurry containing coal in particulate form, as defined above, with or without a catalyst, such as cobalt, manganese, vanadium, or their compounds, can be subjected to a temperature of about 15° to about 225° C. and an oxygen pressure of about atmospheric (ambient) to about 2000 pounds per square inch gauge (about atmospheric to about 13.8 MPa) for about 0.12 to about 20 hours. The product so obtained can then be subjected to mechanical separation, for example, filtration, and the solid residue can be washed with water, if desired. The coal so treated is then treated with a base, as will be defined hereinafter, and then added to water to form the desired novel suspension.

A preferred procedure for preparing the coal having a neutral equivalent within the critical range required herein involves subjecting a slurry containing coal in particulate form to mild oxidation with dilute nitric acid, following, for example, the procedural steps employed in U.S. Pat. No. 4,052,448. Thus, an aqueous slurry containing coal can be contacted with aqueous nitric acid having a concentration of about one to about 90 weight percent, preferably about three to about 70 weight percent, at a temperature of about 15° to about 200° C., preferably about 25° to about 100° C., and a pressure of about atmospheric to about 2000 pounds per square inch gauge (about atmospheric to about 13.8 MPa), preferably about atmospheric to about 500 pounds per square inch gauge (about atmospheric to about 3.4 MPa), for about 0.12 to about 15 hours, preferably about two to about six hours. The oxidation with nitric acid can, if desired, be carried out in an atmosphere containing molecular oxygen, following, for example, the procedure outlined in U.S. Pat. Nos. 4,195,185 and 4,195,186 to Schulz et al. The resulting product can then be subjected to mechanical separation, for example, filtration, and the solid residue can be washed with water, if desired, and dried to produce the coal component having the neutralization values defined above for use in preparing the novel suspensions claimed herein.

However, before the coal product having the required neutralization value can be used to prepare the novel suspensions claimed herein, it must first be treated or reacted with a base. Any base, including the corresponding or basic salt, organic or inorganic, that can react with a carboxyl function, can be used to react with the coal. Thus, hydroxides of the elements of Group IA and Group IIA of the Periodic Table can be used. Of these we prefer to use potassium, sodium or calcium hydroxide. In addition, ammonium hydroxide can also be used. Among the organic bases that can be used are aliphatic amines having from one to 12 carbon atoms, preferably from one to six carbon atoms, such as methylamine, ethylamine and hexamethylenediamine; aromatic amines having from six to 60 carbon atoms, preferably from six to 30 carbon atoms, such as aniline and naphthylamine; aromatic structures carrying nitrogen as a ring substituent, such as pyridine and quinoline; etc. By "basis salt" we mean to include salts of the elements of Group IA and IIA of the Periodic Table whose aqueous solutions exhibit a pH in the basic region, such as potassium carbonate, sodium metasilicate, calcium acetate, barium formate, etc.

The reaction between the coal having the designated neutral equivalent value and the base is easily effected. The amounts of reactants are such that on a weight basis the coal and the base are in the range of about 100:1 to about 6:1, preferably about 50:1 to about 8:1. Mechanically, the reaction can be carried out, for example, by dissolving the base in an aqueous medium, such as water, and adding the coal thereto while stirring. These reactions can be carried out over a wide range of temperatures and pressures, for example, a temperature of about 5° to about 150° C., preferably about 15° to about 90° C., and a pressure of about atmospheric to about 75 pounds per square inch gauge (about atmospheric to about 0.52 MPa), preferably about atmospheric. Water can be removed from the reaction in any convenient manner, for example, by filtration. If desired, however, the water need not be removed from the resulting mixture and the total, together with additional water, if needed, can be used to prepare the novel suspension herein.

The amount of (1) water and (2) the product resulting from the reaction of coal having a neutral equivalent of about 150 to about 485 with a base present in the novel suspension can be varied over a wide range, for example, on a weight basis, from about 4:1 to about 1:4, preferably from about 2:1 to about 1:2.

The suspensions defined and claimed herein are easily prepared. A convenient procedure involves introducing the product resulting from the reaction of coal having a neutral equivalent of about 150 to about 485 with a base into water while mixing the two, for example, for about 0.01 to about 10 hours, sufficient to obtain the desired suspension. Mixing can be effected in any suitable manner, for example, using propeller agitation, turbine agitation, a colloid mill, etc. The suspensions so obtained are stable, as noted, in that there is no separation of water from the coal. When desired, however, the suspensions herein can easily be broken, for example, mechanically by bringing the same into contact with a body, for example, a filter, or chemically, for example, by contact with an acid solution, such as hydrochloric acid. The coal and the water can be separated from each other in any suitable manner, for example, by filtration, and the coal so obtained can be used as desired, for example, as a fuel for burning in a furnace.

DESCRIPTION OF PREFERRED EMBODIMENTS

A Coal (A) was prepared as follows. To a one-gallon glass reactor equipped with a mechanical stirrer and heating and cooling coils there were charged 320 milliliters of water and 100 milliliters of 70 weight percent aqueous nitric acid. The reactor was heated to 80° C. and maintained at this temperature during the entire run. To the resulting mixture there was added 800 grams of Kentucky No. 9 coal having an average particle size such that about 50 percent passed through a 40-mesh sieve and 1140 milliliters of 30.7 weight percent aqueous nitric acid over a five-hour period. The Kentucky No. 9 coal analyzed as follows: 1.1 weight percent water, 67.93 weight percent carbon, 4.83 weight percent hydrogen, 1.50 weight percent nitrogen, 13.03 weight percent oxygen, 4.34 weight percent sulfur and 7.37 weight percent metals. The resulting mixture was held at 80° C. for one hour, with stirring, and then cooled to room temperature and removed from the reactor and filtered. The recovered solids were washed three times with water (1000 milliliters of water each time), dried in a vacuum oven, resulting in the production of 819.1 grams of treated particulate coal. To obtain the neutral equivalent one gram of this product was placed in a 100-milliliter beaker containing a magnetic stirring bar and 40 milliliters of water was added. With stirring there was then added to the beaker 0.2 N sodium hydroxide until a pH of 11 was reached and remained constant for one-half hour. The resulting mixture was back titrated to a pH of 8.0 using 0.2 N HCl and the resulting calculation showed that the treated coal had a neutral equivalent of 473. Neutral equivalents of the remaining coals used hereinafter were similarly determined.

An additional Coal (B) was prepared following the procedure used to obtain Coal A, except that with the addition of the Kentucky No. 9 coal there was added 740 milliliters of 9.5 weight percent of aqueous nitric acid over a period of six hours. The treated coal, amounting to 790.7 grams, was found to have a neutral equivalent of 1000.

A Coal (C) was prepared as follows. To a two-liter beaker, equipped with a mechanical stirrer and wet-ice bath, there was added 600 milliliters of 10 weight percent aqueous nitric acid and 225 grams of North Dakota lignite analyzing as follows: 33 weight percent water, 45.7 weight percent carbon, 2.8 weight percent hydrogen, 11.3 weight percent oxygen, 0.6 weight percent sulfur, 0.6 weight percent nitrogen and 6.0 weight percent metals. The mixture was stirred for two hours at 25° C. and filtered to recover 150.1 grams of treated lignite solids. These solids were then processed following the identical procedure employed in obtaining Coal (A) to recover a reaction product thereof with sodium hydroxide. The treated lignite was found to possess a neutral equivalent of 497.

The filtrate obtained above in preparing Coal (C) was rotovaced to dryness, further dried in a vacuum oven and then extracted with 300 milliliters of acetone to recover 4.7 grams of solids of acetone-soluble, water-soluble, oxidized coal. This was combined with material from similar runs to produce a Coal (D) having a neutral equivalent of 123.

An untreated North Dakota lignite, of the same composition as that employed above in the preparation of Coal (C), was used as Coal (E) having a neutral equivalent of 540.

A Coal (F) was prepared as follows. To a one-liter glass reactor equipped with a mechanical stirrer and heating and cooling coils there were charged 978 milliliters of water and 178.6 milliliters of 70 percent by weight of aqueous nitric acid. The mixture was heated to 60° C., with stirring, and maintained at this temperature during the run. To the resulting mixture there was added a slurry comprised of 800 grams of North Dakota lignite, of the same composition as that employed above in the preparation of Coal (C), and 800 milliliters of water over a one-hour period. The mixture was held at 60° C. for three hours, cooled to room temperature and then removed from the reactor and filtered. The recovered solids were washed three times with water (1000 cubic centimeters each time), dried in a vacuum oven, resulting in the production of 560 grams of treated coal having a neutral equivalent of 200.

A number of suspensions was prepared as follows. Into a Waring Blender there was placed, in each instance, water, solid pellets of potassium hydroxide and then one of the coals identified above. These materials were mixed, at atmospheric temperature and atmospheric pressure, at low speeds (about 500 RPM) for about five minutes, sufficient to obtain reaction between the coal and the base. The resulting mixture was mixed at high speed (about 20,000 RPM) for about 20 minutes and then examined at various intervals of time for stability by noting whether any appreciable settling had occurred. The data obtained are tabulated below in Table II.

TABLE II

| Example No. | Grams of Water | Coal Used | Grams of Coal | Neutral Equivalent of Coal | Grams of KOH | Comments* |
|---|---|---|---|---|---|---|
| I | 200 | A | 100 | 473 | 15 | Stable at end of eight days |
| II | 200 | A | 100 | 473 | 5 | Stable at end of eight days |
| III | 200 | B | 100 | 1000 | 15 | Not stable |
| IV | 200 | B | 100 | 1000 | 5 | Not stable |
| V | 200 | C | 100 | 497 | 15 | Not stable |
| VI | 200 | C | 100 | 497 | 5 | Not stable |
| VII | 200 | D | 100 | 123 | 15 | No suspension; coal soluble in water |
| VIII | 200 | D | 100 | 123 | 5 | No suspension; coal soluble in water |
| IX | 200 | E | 100 | 540 | 15 | Not stable |
| X | 200 | E | 100 | 540 | 5 | Not stable |
| XI | 200 | F | 100 | 200 | 15 | Stable at end of eight days |
| XII | 200 | F | 100 | 200 | 5 | Stable at end of eight days |

*Last day of observation

In each of Example Nos. I, II, XI and XII no settling of coal particles had occurred at the end of the last day of observation. In each of Example Nos. III and IV the coal separated and settled within two hours of the formation of the suspension. In each of Example Nos. V, VI, IX and X, no observations were made until the last day of the test period, that is, the eighth day, at the end of which time the coal had separated and settled. In each of Examples Nos. VII and VIII, the coal solubilized in the water during the mixing procedure. Note that in each of Example Nos. I, II, XI and XIII, wherein the coal used had a neutral equivalent between about 150 and about 485, a stable suspension was obtained.

Obviously, many modifications and variations of the invention, as hereinabove set forth, can be made without departing from the spirit and scope thereof and therefore only such limitations should be imposed as are indicated in the appended claims.

We claim:

1. A suspension containing (A) water and (B) the product resulting from the reaction of (1) coal having a neutral equivalent of about 150 to about 485 with (2) a base.

2. The suspension of claim 1 wherein said coal has a neutral equivalent of about 180 to about 480.

3. The suspension of claim 1 wherein said coal is a bituminous coal.

4. The suspension of claim 1 wherein said coal is lignite.

5. The suspension of claim 1 wherein said coal has been obtained by contacting coal with nitric acid having a concentration of about one to about 90 weight percent at a temperature of about 15° to about 200° C. for about 0.12 to about 15 hours.

6. The suspension of claim 1 wherein said coal has been obtained by contacting coal with nitric acid having a concentration of about three to about 70 weight percent at a temperature of about 25° to about 100° C. for about two to about six hours.

7. The suspension of claim 1 wherein said base is an organic base.

8. The suspension of claim 1 wherein said base is a hydroxide of an element of Group IA of the Periodic Table.

9. The suspension of claim 1 wherein said base is a hydroxide of an element of Group IIA of the Periodic Table.

10. The suspension of claim 1 wherein said base is sodium hydroxide.

11. The suspension of claim 1 wherein said base is potassium hydroxide.

12. The suspension of claim 1 wherein said base is calcium hydroxide.

13. The suspension of claim 1 wherein said reaction with said base is carried out at a temperature of about 5° to about 150° C.

14. The suspension of claim 1 wherein said reaction with said base is carried out at a temperature of about 15° to about 90° C.

15. The suspension of claim 1 wherein the weight ratio of (A) to (B) is in the range of about 4:1 to about 1:4.

16. The suspension of claim 1 wherein the weight ratio of (A) to (B) is in the range of about 2:1 to about 1:2.

17. A process for preparing a suspension which comprises mixing an aqueous mixture containing (A) water and (B) the product resulting from the reaction of (1) coal having a neutral equivalent of about 150 to about 485 with (2) a base for a time sufficient to obtain a suspension.

18. The process of claim 17 wherein said coal has a neutral equivalent of about 180 to about 480.

19. The process of claim 17 wherein said coal is a bituminous coal.

20. The process of claim 17 wherein said coal is lignite.

21. The process of claim 17 wherein said coal has been obtained by contacting coal with nitric acid having a concentration of about one to about 90 weight percent at a temperature of about 15° to about 200° C. for about 0.12 to about 15 hours.

22. The process of claim 17 wherein said coal has been obtained by contacting coal with nitric acid having a concentration of about three to about 70 weight percent at a temperature of about 25° to about 100° C. for about two to about six hours.

23. The process of claim 17 wherein said base is an organic base.

24. The process of claim 17 wherein said base is a hydroxide of an element of Group IA of the Periodic Table.

25. The process of claim 17 wherein said base is a hydroxide of an element of Group IIA of the Periodic Table.

26. The process of claim 17 wherein said base is sodium hydroxide.

27. The process of claim 17 wherein said base is potassium hydroxide.

28. The process of claim 17 wherein said base is calcium hydroxide.

29. The process of claim 17 wherein said reaction with said base is carried out at a temperature of about 5° to about 150° C.

30. The process of claim 17 wherein said reaction with said base is carried out at a temperature of about 15 to about 90° C.

31. The process of claim 17 wherein the weight ratio of (A) to (B) is in the range of about 4:1 to about 1:4.

32. The process of claim 17 wherein the weight ratio of (A) to (B) is in the range of about 2:1 to about 1:2.

* * * * *